United States Patent [19]

Self

[11] 4,245,679

[45] Jan. 20, 1981

[54] DRY CHEMICAL RECOVERY DEVICE FOR FIRE EXTINGUISHERS

[76] Inventor: Freddy R. Self, 933 Parkside Dr., Richmond, Calif. 94803

[21] Appl. No.: 15,445

[22] Filed: Feb. 26, 1979

Related U.S. Application Data

[63] Continuation-in-part of Ser. No. 886,754, Mar. 15, 1978, abandoned.

[51] Int. Cl.[3] ..... B65B 1/26; B65B 31/06

[52] U.S. Cl. ..... 141/2; 141/59; 141/286; 141/311 R

[58] Field of Search ..... 141/1, 2, 59, 286, 3, 141/311 R; 406/121

[56] References Cited

U.S. PATENT DOCUMENTS

| | | | |
|---|---|---|---|
| 1,736,969 | 11/1929 | Greiser | 406/121 |
| 3,875,980 | 4/1975 | Getz | 141/286 X |
| 4,053,001 | 10/1977 | Healey et al. | 141/2 |
| 4,121,632 | 10/1978 | Zehr | 141/59 |

*Primary Examiner*—William D. Martin, Jr.
*Attorney, Agent, or Firm*—Bielen and Peterson

[57] ABSTRACT

A device for the recovery of dry chemicals found in powdered form for fire extinguishers utilizing a container having first and second openings. A conduit permits the powder material to enter the container through the first opening. Another conduit permits the material to exit the second opening into the fire extinguisher. Lumping is prevented by the use of screens and the like within the container. As the material flows through the second opening of the container, air in the fire extinguisher is conveyed through the first opening in the container.

10 Claims, 6 Drawing Figures

FIG-1
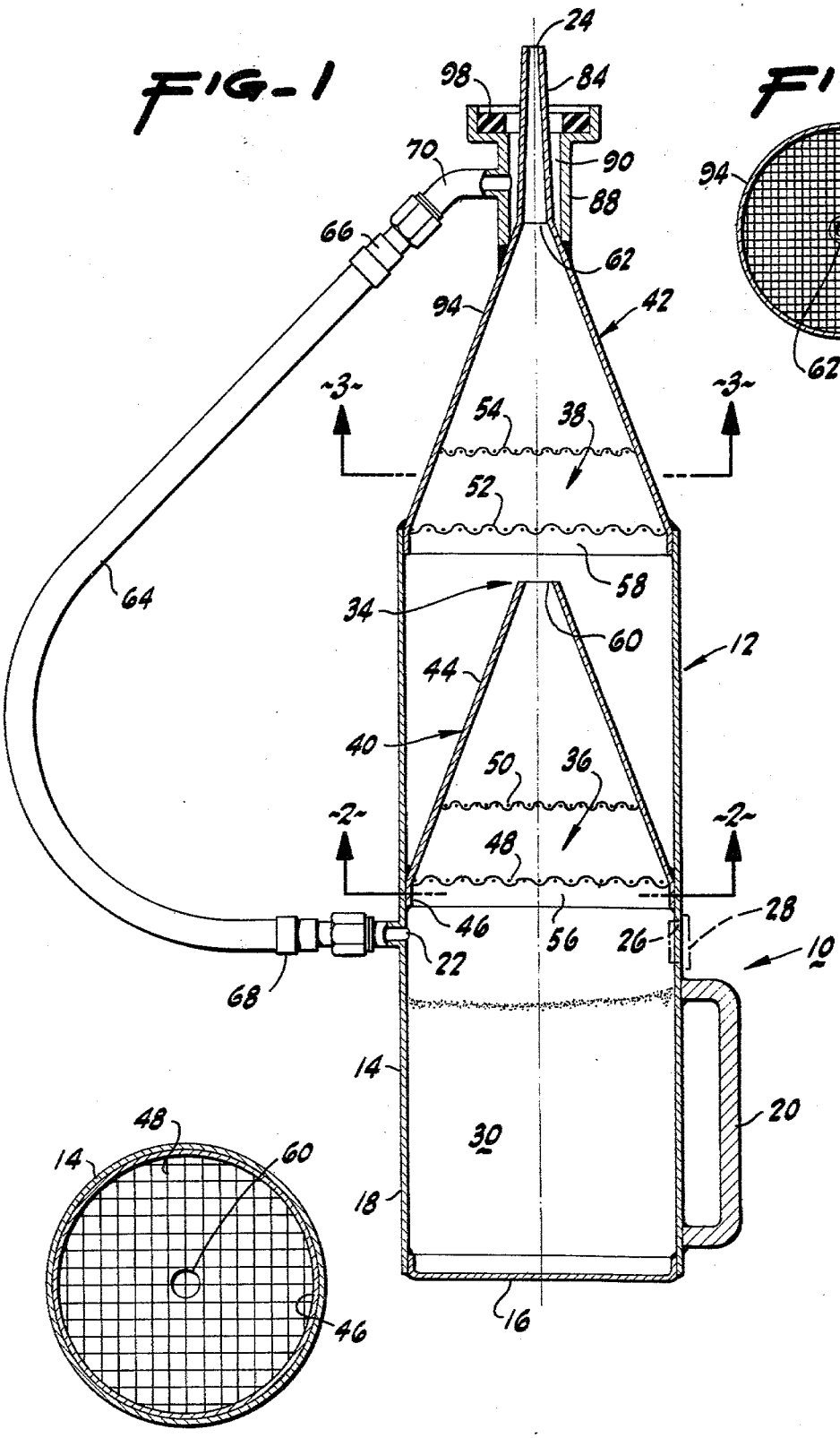
FIG-3
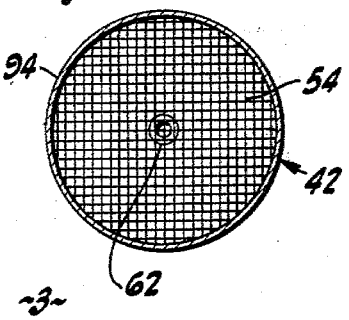
FIG-2

DRY CHEMICAL RECOVERY DEVICE FOR FIRE EXTINGUISHERS

CROSS REFERENCE TO RELATED APPLICATION

The present application is a continuation-in-part of my copending application Ser. No. 886,754, filed Mar. 15, 1978, now abandoned.

BACKGROUND OF THE INVENTION

The present invention relates to a device for recycling powder dry chemicals used in fire extinguishers.

Portable fire extinguishers having a limited capability for putting out fires has found extensive use in recent years. Efficient use of fire extinguishers on fires in their early stages has proved successful in preventing loss of lives and property. Underwriters' Laboratories classifies the basic types of fires encountered. Class A fires are those which consume ordinary combustible material such as paper, wood, and the like. Water or water solutions are quite effective in quenching such a fire. Class B fires are those that involve flammable liquids and greases. A blanketing or smoothering type extinguisher material is required to fight this type of fire. Class C fires are those that occur in live electrical equipment. It is essential that an electrically nonconductive extinguishing agent be employed therefore.

For many years the soda-acid type extinguisher was used to fight Class A fires. The chemical reaction between the soda and sulfuric acid generated gasses which expelled a stream of water. However, such extinguishers were found to be ultimately dangerous in that explosions occurred causing great injury to the user thereof. Originally the dry-chemical extinguishers were usable on Class B and Class C fires. Newer dry-chemical extinguishers employ chemicals that may be used on Class A, B, and C fires and have greatly replaced the old soda-acid type extinguishers which have been outlawed in many jurisdictions.

Dry-chemical fire extinguishers must be recharged periodically. This may be due to the fact that they have been discharged or that the pressurizing inert gas, such as air or nitrogen, has escaped from the fire extinguisher. To recharge such dry-chemical extinguishers, removal of the dry-chemical remaining in the fire extinguisher is required before refilling the fire extinguisher with dry-chemical, recycled or new (make-up). It is required in many places that the amount of dry-chemical used in recharging a fire extinguisher be weighed and that the dry-chemical be visually inspected. Most dry-chemicals used in present day fire extinguishers are quite expensive. In addition, exposure to the same creates a medical hazard. Moreover, the dry-chemical found in powder form behaves erratically when handled. For example, many powdered chemicals lump if not constantly agitated.

Prior method of recycling dry-chemical included releasing the pressure from the fire extinguisher without discharging the dry-chemical, manually shaking the fire extinguisher thus dislodging the dry-chemical and directing the same into a bucket, and pouring the dry-chemical back into the fire extinguisher after visual inspection and weighing. The prior method is time consuming and exposes the operator to the noxious particulate dry-chemical.

A device to recycle dry-chemical quickly and safely is needed.

SUMMARY OF THE INVENTION

In accordance with the present invention a new and useful device for recovering the powdered dry-chemical from fire extinguishers is provided.

The invention consists of a container having first and second openings separated from one another. If the container is constructed as an elongated object the first opening might be located oppositely with respect to the second opening along the axis of elongation. Means for conveying the powdered material is provided such that the same enters the first opening and flows to the inside of the container. Such conveying means may take the form of a flexible hose having a quick disconnect fitting on the ends thereof.

Since the dry-chemical tends to lump, means is provided to attenuate the same. Such attenuation means may take the form of a plurality of screens fixed within the container. Such screens may be placed within a funnel or a pair of funnels in tandum. Again, the funnels aid in the maintaining of the dry-chemical in a flowable condition.

Dry-chemical is then allowed to flow from the second opening of the container into the emptied fire extinguisher. The air within the fire extinguisher which is displaced by the dry-chemical flowing thereinto is directed back to the first opening of the container. Thus, the flowable dry-chemical is aided in its flow through the second opening of the container.

Such means for conducting air from the fire extinguisher to the container may include a first element which substantially surrounds the second opening of the container. Such an element may be elongated and extend into the mouth of the fire extinguisher being filled. A second element is constructed to substantially surround the first element and form a chamber therebetween. The second element includes an opening which permits the use of a conduit for the air leaving the fire extinguisher. This conduit may be connected to the first opening of the container is heretofore described. The device of the present invention may also include sealing means for closing the space between the second element and the mouth of the fire extinguisher. Thus, dry-chemical is prevented from escaping to the external environment during the recharging process.

The present invention may also be deemed to include a method of filling a fire extinguisher with powdered material using the steps of filling the container with the powdered material either by discharging a fire extinguisher or injecting fresh chemical from a separate source. The powdered material is conveyed from the container to the empty fire extinguisher. The lumping endemic to the fire extinguisher dry-chemicals is attenuated. Finally, the flowing dry-chemical is directed into the fire extinguisher while the air displaced by the chemical being loaded into the fire extinguisher is directed to the container.

It may be seen that a novel and useful device for the recovery or recycling of powdered material (dry-chemical) used in fire extinguishers has been described.

It is therefore an object of the present invention to provide a device for the recovery of powdered material for fire extinguishers which is simple, efficient, and safe to use.

It is another object of the present invention to provide a device for the recovery of powdered material for fire extinguishers which permits the discharge of a pressured fire extinguisher directly into a container without unnecessary handling by the user thereof.

It is a further object of the present invention to provide a device for recovery of powdered material for fire extinguishers which is essentailly a closed system minimizing exposure of the user to the dry-chemical.

It is yet another object of the present invention to provide a device for recovery of powdered material for fire extinguishers which prevents the lumping of the dry-chemical during handling, thus accentuating the flow characteristics thereof.

It is another object of the present invention to provide a device for recovery of powdered material for fire extinguishers which facilitates the inspection and weighing of dry-chemical employed for recharging a fire extinguisher.

It is another object of the present invention to provide a device for recovery of powdered material for fire extinguishers which employs the displaced air from the fire extinguisher being charged to aid in the filling of the fire extinguisher by the dry-chemical.

The invention possesses other objects and advantages especially as concerns particular features and characteristics thereof, which will become apparent as the specification continues.

BRIEF DESCRIPTION OF THE DRAWINGS

FIG. 1 is a side elevational view showing the container portion broken away as a sectional view.

FIG. 2 is a view taken along line 2—2 of FIG. 1.

FIG. 3 is a view taken along line 3—3 of FIG. 1.

Figure 6:
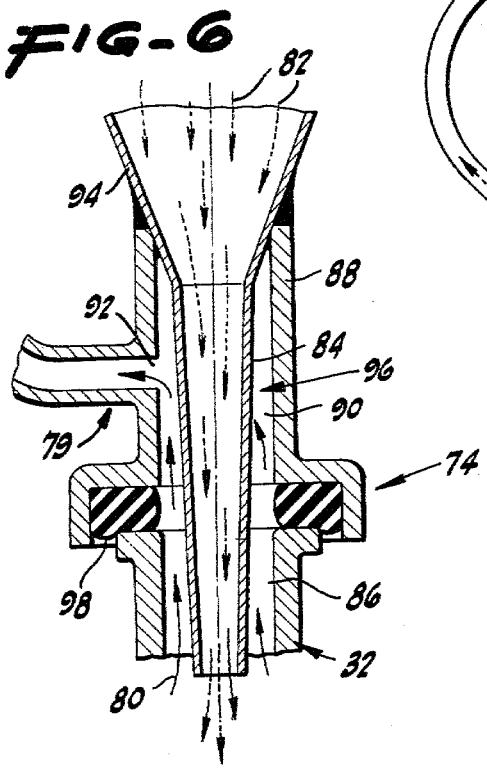
FIG. 6 is a sectional view of the chemical discharge portion of the device, enlarged from FIG. 1.

For a better understanding of the invention reference is made to the following detailed description.

DESCRIPTION OF THE PREFERRED EMBODIMENTS

Various aspects of the present invention will evolve from the following detailed description of the preferred embodiments thereof, which should be taken in conjunction with the heretofore described drawings.

With reference to FIG. 1 the invention as a whole is depicted by reference character 10 and includes as one of its elements a container 12. Typically, container 12 may be constructed of metal such as steel. Since dry-chemicals used in fire extinguishers are very corrosive it is preferable that container 12 be coated, clad, or otherwise protected against corrosion. It has been found that galvanized steel offers adequate protection in this regard. Container 12 includes a shell 14 which includes a bottom portion 16 which is welded or otherwise fastened to main portion 18 thereof. Handle means 20 aids in the moving of container 12, which will be hereinafter described in detail.

With reference to FIG. 1, it may be apparent that bottom portion 16 permits container 12 to rest on a ground surface. Shell 14 of container 12 includes first opening 22 and second opening 24. In addition, access opening 26 having a door 28 permits the inspection of the dry-chemical 30, shown in phantom in FIG. 1.

Figure 4:
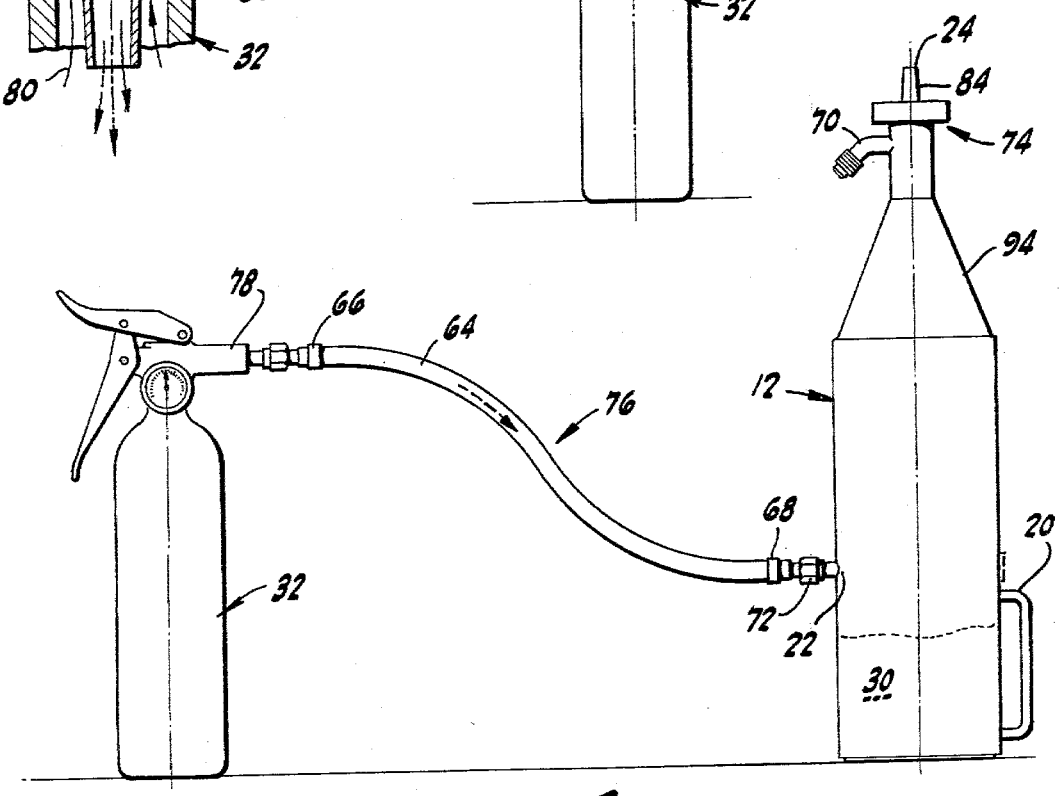
FIG. 4 is a side elevational view illustrating the use of the present device.

Dry chemicals used in fire extinguishers such as fire extinguisher 32, FIG. 4, are normally finely divided powders. Such powdered material may include potassium chloride, potassium bicarbonate, sodium bicarbonate, ammonium phosphate, and others known in the art. It has been found that the powdered form of these chemicals expand with air and pour readily. The absence of air normally causes lumping or caking. Such phenomena may take place simply by permitting the powdered material to sit in an undisturbed state. Normally, pneumatic or mechanical agitation returns the powdered to an easily pourable state.

Device 10 embraces means 34 for attenuating lumping of the powdered material within container 12. Means 34 may take the form of first screen means 36 and/or second screen means 38. As depicted on FIG. 1 screen means 36 and 38 are arranged in tandum and fixed within container 12.

The preferred embodiment of the invention also includes first funnel means 40 and second funnel means 42. First funnel means 40 may take the form of a truncated conical section 44 having a cylindrical ring 46 at one end thereof. First funnel means 40 is welded or otherwise fixed to the inside wall of shell 14. Screen means 36 may include a pair of screens 48 and 50 which are fixed within funnel means 40 toward the cylindrical ring portion thereof. It should be noted that screen means 38 also includes a pair of screens 52 and 54. In the present embodiment screens 48 and 52 and screens 50 and 54 are of an identical mesh size respectively. However, with reference to FIGS. 2 and 3 it should be noted that screens 50 and 54 are of a smaller mesh size than screens 48 and 52. As shown in the drawings, the openings of screens of 48 and 52 are square having a dimension of about one centimeter in length per side. Likewise, screens 54 and 50 are also of a square configuration having a dimension of about one-half of a centimeter in length per side. It should be realized that mesh sizes may be varied depending on the type of powdered material 30 employed. It has been found that screen means 36 and 38 are workable when the mesh sizes of screens 50 and 54 are smaller than the mesh sizes of screens 48 and 52.

Funnel means 40 and 42 possess large openings 56 and 58 respectively on one end thereof. Small openings 60 and 62 of corresponding funnel means 40 and 42 are found opposite large openings 56 and 58. Again, it has been found that openings 62 be slightly smaller than opening 60 as illustrated on FIG. 1, opening 60 is circular and has a diameter of approximately two (2) centimeters. Opening 62 is approximately 0.4 centimeters smaller in diameter than opening 60. In certain embodiments of the present invention, opening 24 and opening 62 may be identically sized.

Flexible hose 64 includes quick disconnect fittings 66 and 68 which mate with fittings 70 and 72 respectively. The device 10 also has as one of its elements means 74 for conveying powdered material 30 to fire extinguisher 32, the details of which will be more fully described hereinafter.

Figure 5:
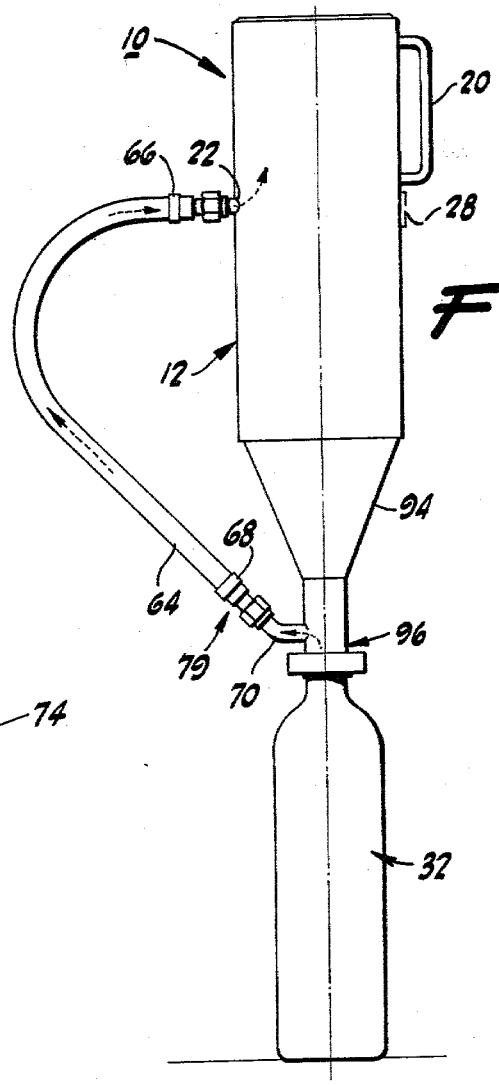
FIG. 5 is a side elevational view depicting the use of the present device.

Turning to FIGS. 4, 5, and 6, it may be seen that flexible hose 64 may serve as means 76 for conveying the powdered material 30 from fire extinguisher 32, through opening 22 to the interior of container 12. In this regard fitting 66 is adapted for connection to the nozzle portion 78 of a typical dry fire extinguisher 32. Moreover, flexible hosing and fittings 66 and 68 serve as means for conveying air from fire extinguisher 32 as shown by FIG. 5 and the directional arrow therein. FIG. 6 clearly illustrates means 78 for conducting air from fire extinguisher 32 to container 12. Directional arrows illustrate the movement of air from fire extinguisher 32 to container 12. Directional arrows 82 show the movement of powdered material 30 from container 12 to fire extinguisher 32. Means 78 may include first element 84 which substantially surrounds second opening 24 of container 12. FIG. 6 depicts first element 84 as having a slight taper, but first element 84 may take the configuration of a right circular cylinder. As shown, first element 84 extends to the inside of mouth 86 of fire extinguisher 32, being of elongated configuration. Second element 88 substantially surrounds first element 84. A chamber 90 is thus formed between first and second elements 84 and 88. Second element 88 includes an opening 92, terminating in fitting 70 of container 12, FIGS. 1 and 4. Opening 92 communicates with chamber 90 and permits the passage of air from fire extinguisher 32 to the container 12 through opening 22, FIG. 5. Second element 88 is fixed to a tapered portion 94 of shell 14 which also serves as the truncated conical section of funnel means 42. Thus, the device 10 may be deemed to include means 96 for conducting air from chamber 90 to the first opening 22 via opening 92 of second element 88. In addition, the device 10 may include means 98 for air sealing the space between second element 88 and the mouth 86 of fire extinguisher 32.

In operation (FIGS. 4, 5, and 6) the user discharges the powdered material 30 from fire extinguisher 32 by means 76 which may include flexible hose 64 to container 12. The powdered material initially enters first opening 22 of container 12 and moves toward bottom portion 16 thereof, FIG. 4. Flexible hose 64 may be used to channel other dry-chemical into container 12 if make-up dry-chemical is required. After the discharge of fire extinguisher 32 container 12 and the appurtenant fittings are weighed. By the mental step of substraction of the known weight of container 12 and its appurtenances from the actual weight of the same containing the dry-chemical, the amount of dry-chemical within container 12 may be determined. Door 28 may be opened to visually inspect the dry-chemical or the user may view residue of the same within the discharged fire extinguisher 32. At this point, flexible hose 64 is connected to fitting 70 and container 12 is turned upside down such that the first element 84, and opening 24 of container 12 communicate with mouth 86 of fire extinguisher 32, FIG. 5. The powdered material 30 then flows through first and second funnel means 40 and 42 and first and second screen means 36 and 38 to opening 62 through element 84 and second opening 24 of container 12 and into fire extinguisher 32, FIG. 6. Air displaced by the entry of powdered material 30 within fire extinguisher 32 is displaced upwardly through chamber 90 and opening 92 to first opening 22 of container 12 via flexible hose 64. The movement of such air aids in maintaining the flow of solid material through means 34 and also prevents powdered material from reentering opening 22. Normally shaking or agitation of the powdered material is not necessary with the use of device 10. However, handle means 20 readily permits the user to impart mechanical agitation to device 10. After the filling of fire extinguisher 32 with powdered material 30 device 10 is removed and compressed air or nitrogen is forced into fire extinguisher 32 to the proper pressure level. Fire extinguisher 32 is then capped and ready for use.

It may be apparent that the present invention also includes a method of filling a fire extinguisher with powdered material including the steps of filling container 12 with powdered material 30, conveying powdered material from container 12 toward fire extinguisher 32, attenuating lumping of the powdered material 30 within container 12, and simultaneously directing the powdered material into fire extinguisher 32 and conducting the displaced air from fire extinguisher 32 to container 12.

It may also be apparent that a new and useful device for recovering expensive powdered material used in fire extinguishers as well as a method for filling fire extinguishers with powdered material, has been described.

While in the foregoing specification embodiments of the invention have been set forth in considerable detail for the purposes of making a complete disclosure of the invention it will be apparent to those of ordinary skill in the art that numerous changes may be made in such details, without departing from the spirit and principles of the invention.

I claim:

1. A device for recovery of powdered material for fire extinguishers comprising:

a. a container having first and second openings therein, said first opening being spaced from said second opening;

b. means for conveying the powdered material through said first opening of said container to the inside of said container;

c. means for conveying the powdered material through said second opening of said container to the fire extinguisher;

d. means for conducting air from said fire extinguisher to said container for aiding said conveyance of the powdered material through said second opening of said container;

e. means for attenuating lumping of the powdered material before egress of the powdered material through said second opening of said container.

2. The device of claim 1 in which means for conducting air from said fire extinguisher to said container comprises:

a. first element substantially surrounding said second opening and being elongated for extention to the fire extinguisher;

b. second element substantially surrounding said first element and forming a chamber thereby, said second element including an opening therethrough to said chamber, said chamber being communicable with the interior of the fire extinguisher;

c. means for conduiting air from said chamber through said opening in said second element to said first opening in said container.

3. The device of claim 2 which additionally comprises means for air sealing the space between said second element and said fire extinguisher.

4. The device of claim 1 in which said means for attenuating lumping of the powdered material comprises screen means for dividing said powdered material, said first screen means being fixed within said container.

5. The device of claim 4 in which said means for attenuating lumping of the powdered material additionally comprises funnel means for channeling the powdered material from said container toward said second opening of said container.

6. The device of claim 5 in which said screen means is first screen means and said funnel means is first funnel means and said means for attenuating lumping of the powdered material additionally comprises:

a. second screen means for dividing said powdered material, said second screen means being fixed to the inside of said container;

b. second funnel means for channeling the powdered material from said first funnel means toward said second opening of said container.

7. The device of claim 6 in which said first and second screen means each comprise a pair of screens fixed within said first and second funnel means respectively.

8. The device of claim 7 in which said means for conducting air from said fire extinguisher to said container for aiding said conveyance of the powdered material through said second opening of said container comprises:

a. a first element substantially surrounding said second oepning and being elongated for extention to the fire extinguisher;

b. a second element substantially surrounding said first element and forming a chamber thereby, said second element including an opening therethrough to said chamber; said chamber being communicable with the interior of the fire extinguisher;

c. means for conducting air from said chamber through said opening in said second element to said first opening in said container.

9. The device of claim 8 in which additionally comprises means for air sealing the space between said second element and said fire extinguisher.

10. A method of filling a fire extinguisher with powdered material comprising the steps of:

a. filling a container with powdered material;

b. conveying the powdered material from said container toward the fire extinguisher;

c. attenuating lumping of the powdered material within said container;

d. simultaneously directing the powdered material into the fire extinguisher and conducting the displaced air from the fire extinguisher to said container.

* * * * *